US011655583B2

(12) United States Patent
Herman et al.

(10) Patent No.: US 11,655,583 B2
(45) **Date of Patent: *May 23, 2023**

(54) METHOD FOR DRYING ARTICLES

(71) Applicant: WHIRLPOOL CORPORATION, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 280 days.

This patent is subject to a terminal disclaimer.

(21) Appl. No.: 17/036,455

(22) Filed: Sep. 29, 2020

(65) Prior Publication Data

US 2021/0025652 A1 Jan. 28, 2021

Related U.S. Application Data

(63) Continuation of application No. 16/225,581, filed on Dec. 19, 2018, now Pat. No. 10,816,265, which is a (Continued)

(51) Int. Cl.
*D06F 58/26* (2006.01)
*F26B 3/347* (2006.01)

(Continued)

(52) U.S. Cl.
CPC ..... *D06F 58/266* (2013.01); *F26B 3/28* (2013.01); *F26B 3/34* (2013.01); *F26B 3/347* (2013.01);

(Continued)

(58) Field of Classification Search
CPC .... F26B 3/28; F26B 3/34; F26B 3/347; D06F 58/26; D06F 58/266; D06F 58/04; D06F 58/02

See application file for complete search history.

(56) References Cited

U.S. PATENT DOCUMENTS 1,503,224 A 7/1924 Blaine
1,871,269 A 8/1932 Hobrock (Continued)

FOREIGN PATENT DOCUMENTS

EP 0269358 A2 6/1988
EP 1753265 A1 2/2007

(Continued)

OTHER PUBLICATIONS

European Search Report for Corresponding EP141785683., dated Feb. 16, 2015.

(Continued)

*Primary Examiner* — David J Laux
(74) *Attorney, Agent, or Firm* — McGarry Bair PC

(57) ABSTRACT

A method for drying an article with a radio frequency (RF) applicator having anode elements and cathode elements includes capacitively coupling the anode elements, capacitively coupling the cathode elements, capacitively coupling an anode element to a cathode element, and energizing the RF applicator to generate an RF field between anode and cathode elements wherein liquid residing within the field will be dielectrically heated.

18 Claims, 7 Drawing Sheets

Related U.S. Application Data continuation of application No. 15/369,967, filed on Dec. 6, 2016, now Pat. No. 10,184,718, which is a continuation of application No. 13/943,918, filed on Jul. 17, 2013, now Pat. No. 9,541,330.

(51) Int. Cl.

| | |
|---|---|
| ***H05B 6/54*** | (2006.01) |
| ***H05B 6/62*** | (2006.01) |
| ***F26B 3/34*** | (2006.01) |
| ***F26B 3/28*** | (2006.01) |
| ***D06F 58/04*** | (2006.01) |

(52) U.S. Cl.

CPC ..... *H05B 6/54* (2013.01); *H05B 6/62* (2013.01); *D06F 58/04* (2013.01)

(56) References Cited

U.S. PATENT DOCUMENTS

| | | | |
|---|---|---|---|
| 2,112,418 | A | 3/1938 | Hart, Jr. et al. |
| 2,212,522 | A | 8/1940 | Hart, Jr. et al. |
| 2,226,871 | A | 12/1940 | Nicholas |
| 2,228,136 | A | 1/1941 | Hart, Jr. |
| 2,231,457 | A | 2/1941 | Stephen |
| 2,276,996 | A | 3/1942 | Milinowski |
| 2,373,374 | A | 4/1945 | Bierwirth |
| 2,449,317 | A | 9/1948 | Pitman |
| 2,464,403 | A | 3/1949 | Klingaman |
| 2,473,251 | A | 6/1949 | Hsu |
| 2,492,187 | A | 12/1949 | Rusca |
| 2,511,839 | A | 6/1950 | Frye |
| 2,512,311 | A | 6/1950 | Davis |
| 2,542,589 | A | 2/1951 | Stanton et al. |
| 2,642,000 | A | 6/1953 | Wieking |
| 2,656,839 | A | 10/1953 | Howard |
| 2,740,756 | A | 4/1956 | Thomas |
| 2,773,162 | A | 12/1956 | Christensen |
| 3,089,327 | A | 5/1963 | Stilwell, Jr. |
| 3,161,480 | A | 12/1964 | Birch-Iensen et al. |
| 3,184,637 | A | 5/1965 | Skinner |
| 3,316,380 | A | 4/1967 | Pansing |
| 3,329,796 | A | 7/1967 | Manwaring |
| 3,355,812 | A | 12/1967 | Benneii |
| 3,404,466 | A | 10/1968 | Reid |
| 3,426,439 | A | 2/1969 | Ryman et al. |
| 3,439,431 | A | 4/1969 | Heidtmann |
| 3,537,185 | A | 11/1970 | Ingram |
| 3,543,408 | A | 12/1970 | Candor et al. |
| 3,599,342 | A | 8/1971 | Cotton |
| 3,601,571 | A | 8/1971 | Curcio |
| 3,652,816 | A | 3/1972 | Preston |
| 3,701,875 | A | 10/1972 | Witsey et al. |
| 3,754,336 | A | 8/1973 | Feild |
| 3,878,619 | A | 4/1975 | Hodgett et al. |
| 3,953,701 | A | 4/1976 | Manwaring |
| 4,014,732 | A | 3/1977 | Beckert et al. |
| 4,028,518 | A | 6/1977 | Bourdouris et al. |
| 4,119,826 | A | 10/1978 | Chambley et al. |
| 4,197,851 | A | 4/1980 | Fellus |
| 4,296,298 | A | 10/1981 | Macmaster et al. |
| 4,296,299 | A | 10/1981 | Stottmann et al. |
| 4,334,136 | A | 6/1982 | Mahan et al. |
| 4,365,622 | A | 12/1982 | Harrison |
| 4,409,541 | A | 10/1983 | Richards |
| 4,471,537 | A | 9/1984 | Meda |
| 4,499,818 | A | 2/1985 | Strong |
| 4,523,387 | A | 6/1985 | Mahan |
| 4,529,855 | A | 7/1985 | Fleck |
| 4,625,432 | A | 12/1986 | Baltes |
| 4,638,571 | A | 1/1987 | Cook |
| 4,692,581 | A | 9/1987 | Mizutani et al. |
| 4,845,329 | A | 7/1989 | Vaz et al. |
| 4,918,290 | A | 4/1990 | Demars |
| 4,949,477 | A | 8/1990 | Geiger |
| 5,064,979 | A | 11/1991 | Jaeger |
| 5,152,075 | A | 10/1992 | Bonar |
| 5,197,202 | A | 3/1993 | Jensen |
| 5,282,321 | A | 2/1994 | Huttlin |
| 5,303,484 | A | 4/1994 | Hagen et al. |
| 5,394,619 | A | 3/1995 | Kaplan |
| 5,495,250 | A | 2/1996 | Ghaem et al. |
| 5,553,532 | A | 9/1996 | de la Luz-Martinez et al. |
| 5,659,972 | A | 8/1997 | Min et al. |
| 5,692,317 | A | 12/1997 | Manzolli |
| 5,819,431 | A | 10/1998 | Lancer |
| 5,838,111 | A | 11/1998 | Hayashi et al. |
| 5,853,579 | A | 12/1998 | Rummler et al. |
| 5,877,090 | A | 3/1999 | Padmapani et al. |
| 5,886,081 | A | 3/1999 | Sternowski |
| 5,983,520 | A | 11/1999 | Kim et al. |
| 6,124,584 | A | 9/2000 | Blaker et al. |
| 6,263,591 | B1 | 7/2001 | La Porte |
| 6,303,166 | B1 | 10/2001 | Kolbe et al. |
| 6,367,165 | B1 | 4/2002 | Huttlin |
| 6,421,931 | B1 | 7/2002 | Chapman |
| 6,531,880 | B1 | 3/2003 | Schneider et al. |
| 6,546,109 | B1 | 4/2003 | Gnecco et al. |
| 6,649,879 | B1 | 11/2003 | Kohlstrung |
| 6,812,445 | B2 | 11/2004 | Gorbold |
| 7,526,879 | B2 | 5/2009 | Bae et al. |
| 7,619,403 | B2 | 11/2009 | Kashida |
| 7,676,953 | B2 | 3/2010 | Magill |
| 7,883,609 | B2 | 2/2011 | Petrenko et al. |
| RE43,519 | E | 7/2012 | Gnecco et al. |
| 8,499,472 | B2 | 8/2013 | Bari et al. |
| 8,789,599 | B2 | 7/2014 | Parsche |
| 8,826,561 | B2 | 9/2014 | Wisherd et al. |
| 8,839,527 | B2 | 9/2014 | Ben-Shmuel et al. |
| 8,943,705 | B2 | 2/2015 | Wisherd et al. |
| 9,127,400 | B2 | 9/2015 | Herman et al. |
| 9,173,253 | B2 | 10/2015 | Wohl et al. |
| 9,194,625 | B2 | 11/2015 | Herman et al. |
| 9,200,402 | B2 | 12/2015 | Wisherd et al. |
| 9,410,282 | B2 | 8/2016 | Herman et al. |
| 9,447,537 | B2 | 9/2016 | Wisherd et al. |
| 9,540,759 | B2 | 1/2017 | Herman et al. |
| 9,541,330 | B2 * | 1/2017 | Herman ..... H05B 6/62 |
| 9,546,817 | B2 | 1/2017 | Herman et al. |
| 9,605,899 | B2 | 3/2017 | Herman |
| 9,645,182 | B2 | 5/2017 | Herman et al. |
| 9,784,499 | B2 | 10/2017 | Herman |
| 10,184,718 | B2 * | 1/2019 | Herman ..... H05B 6/62 |
| 10,323,881 | B2 | 6/2019 | Herman et al. |
| 10,533,798 | B2 | 1/2020 | Herman et al. |
| 10,655,270 | B2 | 5/2020 | Herman et al. |
| 10,816,265 | B2 * | 10/2020 | Herman ..... D06F 58/266 |
| 11,078,619 | B2 | 8/2021 | Herman et al. |
| 2002/0047009 | A1 | 4/2002 | Flugstad et al. |
| 2003/0199251 | A1 | 10/2003 | Gorbold |
| 2004/0149734 | A1 | 8/2004 | Petrenko et al. |
| 2005/0120715 | A1 | 6/2005 | Labrador |
| 2005/0278972 | A1 | 12/2005 | Maruca |
| 2005/0286914 | A1 | 12/2005 | Nagahama |
| 2006/0097726 | A1 | 5/2006 | Frederick et al. |
| 2006/0289526 | A1 | 12/2006 | Takizaki et al. |
| 2007/0045307 | A1 | 3/2007 | Tsui et al. |
| 2007/0113421 | A1 | 5/2007 | Uhara et al. |
| 2007/0193058 | A1 | 8/2007 | Zarembinski |
| 2008/0134792 | A1 | 6/2008 | Lee et al. |
| 2008/0256826 | A1 | 10/2008 | Zarembinski |
| 2009/0151193 | A1 | 6/2009 | Moon et al. |
| 2009/0172965 | A1 | 7/2009 | Campagnolo et al. |
| 2009/0195255 | A1 | 8/2009 | Kalokitis et al. |
| 2010/0043527 | A1 | 2/2010 | Marra |
| 2010/0103095 | A1 | 4/2010 | Yamamoto et al. |
| 2010/0115785 | A1 | 5/2010 | Ben-Shmuel et al. |
| 2010/0146805 | A1 | 6/2010 | Kim et al. |
| 2011/0049133 | A1 | 3/2011 | Przybyla |
| 2011/0245900 | A1 | 10/2011 | Turner et al. |
| 2011/0308101 | A1 | 12/2011 | Wisherd et al. |
| 2012/0000087 | A1 | 1/2012 | Da Riol et al. |
| 2012/0164022 | A1 | 6/2012 | Muginstein et al. |
| 2012/0247800 | A1 | 10/2012 | Shah et al. |

(56) References Cited

U.S. PATENT DOCUMENTS

| | | | |
|---|---|---|---|
| 2012/0291304 | A1 | 11/2012 | Wisherd et al. |
| 2013/0024169 | A1 | 1/2013 | Veerasamy |
| 2013/0119055 | A1 | 5/2013 | Wohl et al. |
| 2013/0201068 | A1 | 8/2013 | Alexopoulos et al. |
| 2013/0207674 | A1 | 8/2013 | Hahl et al. |
| 2013/0271811 | A1 | 10/2013 | Lam et al. |
| 2013/0316051 | A1 | 11/2013 | Van Der Voort et al. |
| 2014/0159716 | A1 | 6/2014 | McCollough, Jr. et al. |
| 2014/0300369 | A1 | 10/2014 | Hart |
| 2014/0325865 | A1 | 11/2014 | Wisherd et al. |
| 2015/0020403 | A1 | 1/2015 | Herman et al. |
| 2015/0047218 | A1 | 2/2015 | Herman et al. |
| 2015/0052775 | A1 | 2/2015 | Herman et al. |
| 2015/0089829 | A1 | 4/2015 | Herman et al. |
| 2015/0101207 | A1 | 4/2015 | Herman et al. |
| 2015/0102801 | A1 | 4/2015 | Herman et al. |
| 2015/0159949 | A1 | 6/2015 | Herman et al. |
| 2015/0187971 | A1 | 7/2015 | Sweeney et al. |
| 2015/0364910 | A1 | 12/2015 | Konoto et al. |
| 2015/0377795 | A1 | 12/2015 | Zhao et al. |
| 2016/0281290 | A1 | 9/2016 | Herman et al. |
| 2016/0322343 | A1 | 11/2016 | Scanlan |
| 2017/0089639 | A1 | 3/2017 | Herman et al. |
| 2017/0350651 | A1 | 12/2017 | Herman et al. |
| 2018/0031316 | A1 | 2/2018 | Herman et al. |
| 2018/0266041 | A1 | 9/2018 | Herman et al. |
| 2019/0062914 | A1 | 2/2019 | King et al. |
| 2019/0128605 | A1 | 5/2019 | Herman et al. |
| 2019/0271504 | A1 | 9/2019 | Herman et al. |
| 2020/0240071 | A1 | 1/2020 | Eisenman et al. |
| 2020/0149812 | A1 | 5/2020 | Herman et al. |
| 2021/0078013 | A1 | 3/2021 | Kochhar et al. |
| 2021/0324570 | A1 | 10/2021 | Herman et al. |

FOREIGN PATENT DOCUMENTS

| | | | |
|---|---|---|---|
| EP | 2827087 | A1 | 1/2015 |
| EP | 2840340 | A2 | 2/2015 |
| EP | 3073008 | A1 | 9/2016 |
| EP | 3073008 | B1 | 11/2017 |
| GB | 501855 | A | 5/1948 |
| GB | 1255292 | A | 12/1971 |
| GB | 2019543 | A | 10/1979 |
| JP | 4307095 | A | 10/1992 |
| WO | 2009106906 | A1 | 9/2009 |
| WO | 2012001523 | A2 | 1/2012 |

OTHER PUBLICATIONS

"British Help American Wounded: Rehabilitation and Treatment, UK, 1944", Ministry of Information Second World War Official.

European Search Report for Corresponding EP14179021.2, dated Feb. 3, 2015.

European Search Report for Counterpart EP16155782.2, dated Jul. 28, 2016.

European Search Report for Corresponding EP14175081.0, dated Dec. 4, 2014.

* cited by examiner

METHOD FOR DRYING ARTICLES

CROSS REFERENCE TO RELATED APPLICATIONS

This application is a continuation of U.S. patent application Ser. No. 16/225,581, filed on Dec. 19, 2018, now U.S. Pat. No. 10,816,265, issued Oct. 27, 2020, which is a continuation of U.S. patent application Ser. No. 15/369,967, filed Dec. 6, 2016, now U.S. Pat. No. 10,184,718, issued Jan. 22, 2019, which is a continuation of U.S. patent application Ser. No. 13/943,918, filed Jul. 17, 2013, now U.S. Pat. No. 9,541,330, issued Jan. 10, 2017, the contents of which are incorporated herein by reference in their entirety.

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textile material.

When applying an RF electronic field (e-field) to a wet article, such as a clothing material, the e-field may cause the water molecules within the e-field to dielectrically heat, generating thermal energy which effects the rapid drying of the articles.

BRIEF DESCRIPTION OF THE INVENTION

One aspect of the invention is directed to a method to dry an article in a dryer drum with a radio frequency (RF) applicator having a first partial anode ring disposed adjacent to the lowest gravitational point of the drum, a second anode element, a first partial cathode ring disposed adjacent to the lowest gravitational point of the drum opposite the first partial anode ring, and a second cathode element. The method comprises electrically coupling an electrode of the RF applicator to the first partial anode ring and another electrode of the RF applicator to the first partial cathode ring. Capacitively coupling the first partial anode ring to the second anode element, and the first partial cathode ring to the second cathode element. Capacitively coupling the second anode element to the second cathode element. Energizing the RF applicator to energize the first partial anode ring and the first partial cathode ring, thereby inducing energization between the first partial anode ring and the second anode, and between the first partial cathode ring and the second cathode respectively to generate a field of electromagnetic radiation (e-field) between the second anode and second cathode elements. Liquid in the article residing within the e-field is dielectrically heated by the field to effect a drying of the article.

Another aspect of the invention is directed to an article treatment appliance to dry an article according to a predetermined cycle of operation. The article treatment appliance has a first partial anode ring partially encircling a first radial segment of a drum and disposed adjacent to the lowest gravitational point of the drum. A first partial cathode ring partially encircling a second radial segment of the drum disposed adjacent to the lowest gravitational point of the drum and opposite the first partial anode ring. A second anode element and a second cathode element. The first partial anode ring is capacitively coupled with the second anode element and operably separated by a dielectric. The first partial cathode ring is capacitively coupled with the second cathode element and operably separated by a dielectric. The second anode element is capacitively coupled with the second cathode element and operably spaced from each other, and a radio frequency (RF) applicator with an electrode electrically coupled with the first partial anode ring and another electrode electrically coupled with the first partial cathode ring. The RF applicator is operable to selectively energize the first partial anode ring and the first partial cathode ring in a radio frequency spectrum. The energization of the first partial anode ring and first partial cathode ring induces energization between the first partial anode ring and the second anode, between the first partial cathode ring and the second cathode, and between the second anode and the second cathode to generate a field of electromagnetic radiation in the radio frequency spectrum between the second anode and the second cathode, operable to dielectrically heat liquid within the article.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figure 1:
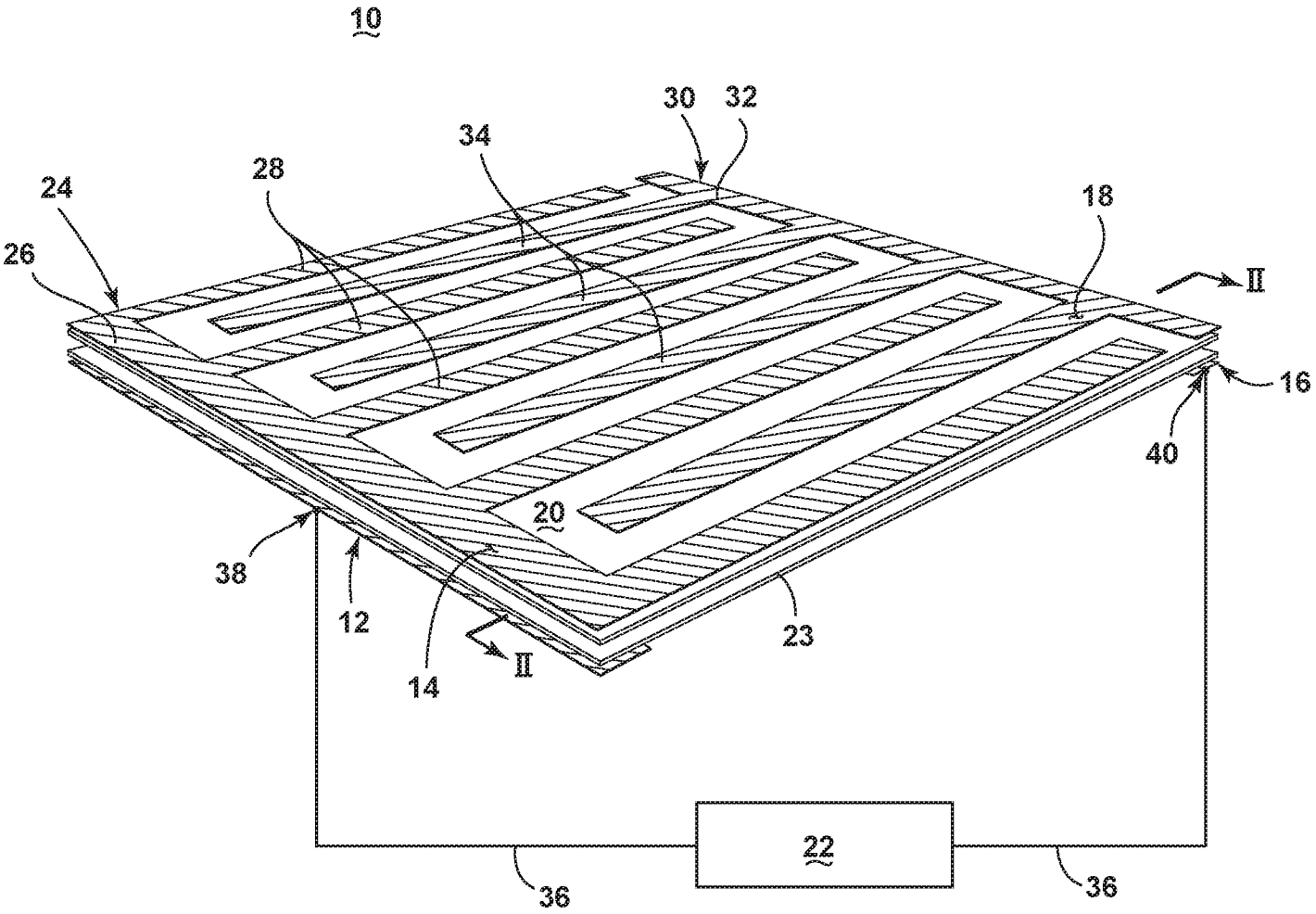
FIG. 1 is a schematic perspective view of the laundry treating apparatus in accordance with the first embodiment of the invention.

FIG. 1 is a schematic illustration of a laundry treating appliance 10 according to the first embodiment of the invention for dehydrating one or more articles, such as articles of clothing. As illustrated in FIG. 1, the laundry treating appliance 10 has a structure that includes conductive elements, such as a first cathode element 12 and a second cathode element 14, and an opposing first anode element 16, a second anode element 18, in addition to a first non-conductive laundry support element 20, an optional second non-conductive support element 23, and an RF applicator 22.

The second cathode element 14 further includes a first comb element 24 having a first base 26 from which extend a first plurality of teeth 28, and the second anode element 18 includes a second comb element 30 having a second base 32 from which extend a second plurality of teeth 34. The second cathode and second anode elements 14, 18 are fixedly mounted to the first supporting element 20 in such a way as to interdigitally arrange the first and second pluralities of teeth 28, 34. The second cathode and second anode elements 14, 18 may be fixedly mounted to the first support element 20 by, for example, adhesion, fastener connections, or laminated layers. Additionally, the first cathode and anode elements 12, 16 are shown fixedly mounted to the second support element 23 by similar mountings. Alternative mounting techniques may be employed.

At least a portion of either the first or second support elements 20, 23 separates an at least partially aligned first cathode and second cathode elements 12, 14. As illustrated, the elongated first cathode element 12 aligns with the substantially rectangular first base 26 portion of the second cathode element 14, through the first support element 20 and second support element 23, with the support elements 20, 23 separated by an optional air gap 70. Similarly shown, the elongated first anode element 16 at least partially aligns with the substantially rectangular second base 32 portion of the second anode element 18 through a portion of the first support element 20 and second support element 23, with the support elements 20, 23 separated by an air gap 70. The aligned portions of the first and second cathode elements 12, 14 are oppositely spaced, on the supporting elements 20, 23, from the aligned portion of the first and second anode elements 16, 18.

The RF applicator 22 may be configured to generate a field of electromagnetic radiation (e-field) within the radio frequency spectrum between outputs electrodes and may be electrically coupled between the first cathode element 12 and the first anode element 16 by conductors 36 connected to at least one respective first anode and cathode contact point 38, 40. One such example of an RF signal generated by the RF applicator 22 may be 13.56 MHz. The generation of another RF signal, or varying RF signals, is envisioned.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of laundry. In contrast with a conventional microwave heating appliance, where microwaves generated by a magnetron are directed into a resonant cavity by a waveguide, the RF applicator 22 induces a controlled electromagnetic field between the cathode and anode elements 12, 14, 16, 18. Stray-field or through-field electromagnetic heating provides a relatively deterministic application of power as opposed to conventional microwave heating technologies where the microwave energy is randomly distributed (by way of a stirrer and/or rotation of the load). Consequently, conventional microwave technologies may result in thermal runaway effects or arcing that are not easily mitigated when applied to certain loads (such as metal zippers etc.). Stated another way, using a water analogy where water is analogous to the electromagnetic radiation, a microwave acts as a sprinkler while the above-described RF applicator 22 is a wave pool. It is understood that the differences between microwave ovens and RF dryers arise from the differences between the implementation structures of applicator vs. magnetron/waveguide, which renders much of the microwave solutions inapplicable for RF dryers.

Each of the conductive cathode and anode elements 12, 14, 16, 18 remain at least partially spaced from each other by a separating gap, or by non-conductive segments, such as by the first and second support elements 20, 23, or by the optional air gap 70. The support elements 20, 23 may be made of any suitable low loss, fire retardant materials, or at least one layer of insulating materials that isolates the conductive cathode and anode elements 12, 14, 16, 18. The support elements 20, 23 may also provide a rigid structure for the laundry treating appliance 10, or may be further supported by secondary structural elements, such as a frame or truss system. The air gap 70 may provide enough separation to prevent arcing or other unintentional conduction, based on the electrical characteristics of the laundry treating apparatus 10.

Figure 2:
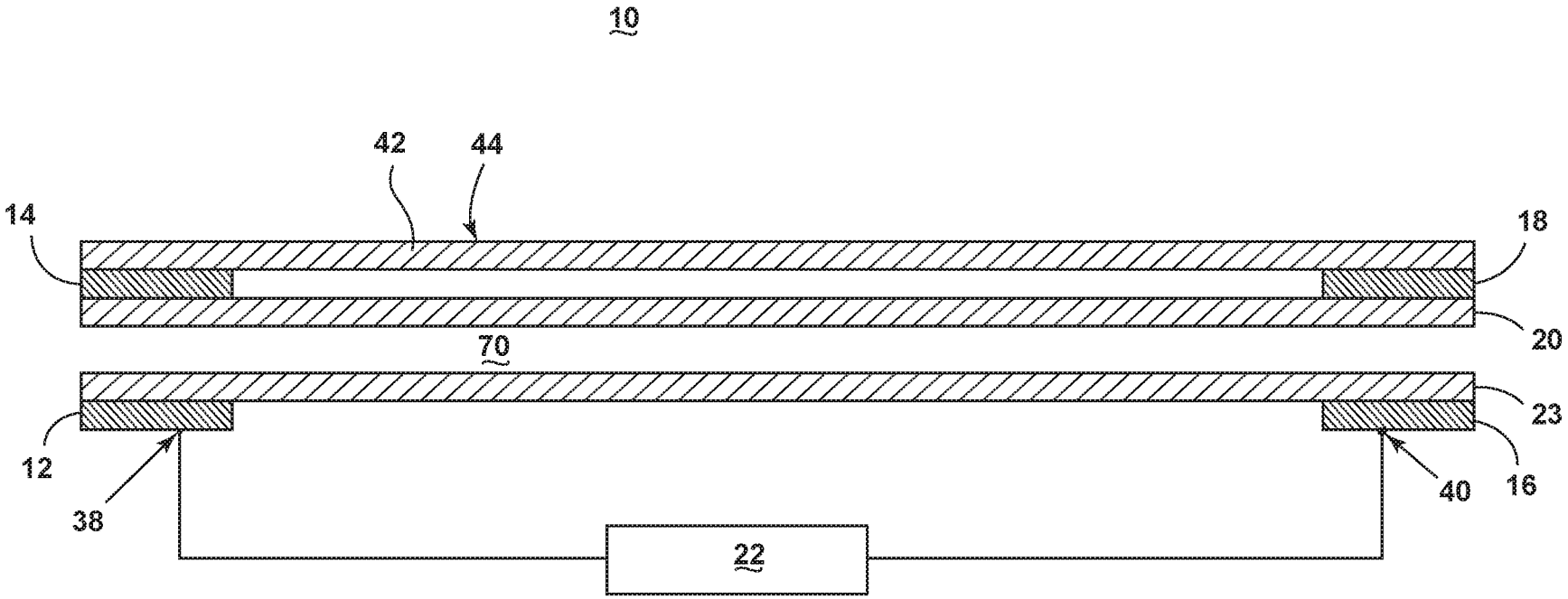
FIG. 2 is a partial sectional view taken along line 2-2 of FIG. 1 in accordance with the first embodiment of the invention.

Turning now to the partial sectional view of FIG. 2, taken along line 2-2 of FIG. 1 in accordance with the first embodiment of the invention, the first support element 20 may further include a non-conductive bed 42 wherein the bed 42 may be positioned above the interdigitally arranged pluralities of teeth 28, 34 (not shown in FIG. 2). The bed 42 further includes a substantially smooth and flat upper surface 44 for receiving wet laundry. The bed 42 may be made of any suitable low loss, fire retardant materials that isolate the conductive elements from the articles to be dehydrated.

The aforementioned structure of the laundry treating appliance 10 operates by creating a first capacitive coupling between the first cathode element 12 and the second cathode element 14 separated by at least a portion of the at least one support element 20, 23, a second capacitive coupling between the first anode element 16 and the second anode element 18 separated by at least a portion of the at least one support element 20, 23, and a third capacitive coupling between the pluralities of teeth 28, 34 of the second cathode element 14 and the second anode element 18, at least partially spaced from each other. During drying operations, wet laundry to be dried may be placed on the upper surface 44 of the bed 42. During, for instance, a predetermined cycle of operation, the RF applicator 22 may be continuously or intermittently energized to generate an e-field between the first, second, and third capacitive couplings which interacts with liquid in the laundry. The liquid residing within the e-field will be dielectrically heated to effect a drying of the laundry.

Many other possible configurations in addition to that shown in the above figures are contemplated by the present embodiment. For example, one embodiment of the invention contemplates different geometric shapes for the laundry treating appliance 10, such as substantially longer, rectangular appliance 10 where the cathode and anode elements 12, 14, 16, 18 are elongated along the length of the appliance 10, or the longer appliance 10 includes a plurality of cathode and anode element 12, 14, 16, 18 sets. In such a configuration, the upper surface 44 of the bed 42 may be smooth and slightly sloped to allow for the movement of wet laundry or water across the laundry treating appliance 10, wherein the one or more cathode and anode element 12, 14, 16, 18 sets may be energized individually or in combination by one or more RF applicators 22 to dry the laundry as it traverses the appliance 10. Alternatively, the bed 42 may be mechanically configured to move across the elongated laundry treating appliance 10 in a conveyor belt operation, wherein the one or more cathode and anode element 12, 14, 16, 18 sets may be energized individually or in combination by one or more RF applicators 22 to dry the laundry as it traverses the appliance 10.

Additionally, a configuration is envisioned wherein only a single support element 20 separates the first cathode and anode elements 12, 16 from their respective second cathode and anode elements 14, 18. This configuration may or may not include the optional air gap 70. In another embodiment, the first cathode element 12, first anode element 16, or both elements 12, 16 may be positioned on the opposing side of the second support element 23, within the air gap 70. In this embodiment, the air gap 70 may still separate the elements 12, 16 from the first support element 20, or the elements 12, 16 may be in communication with the first support element 20.

Figure 3:
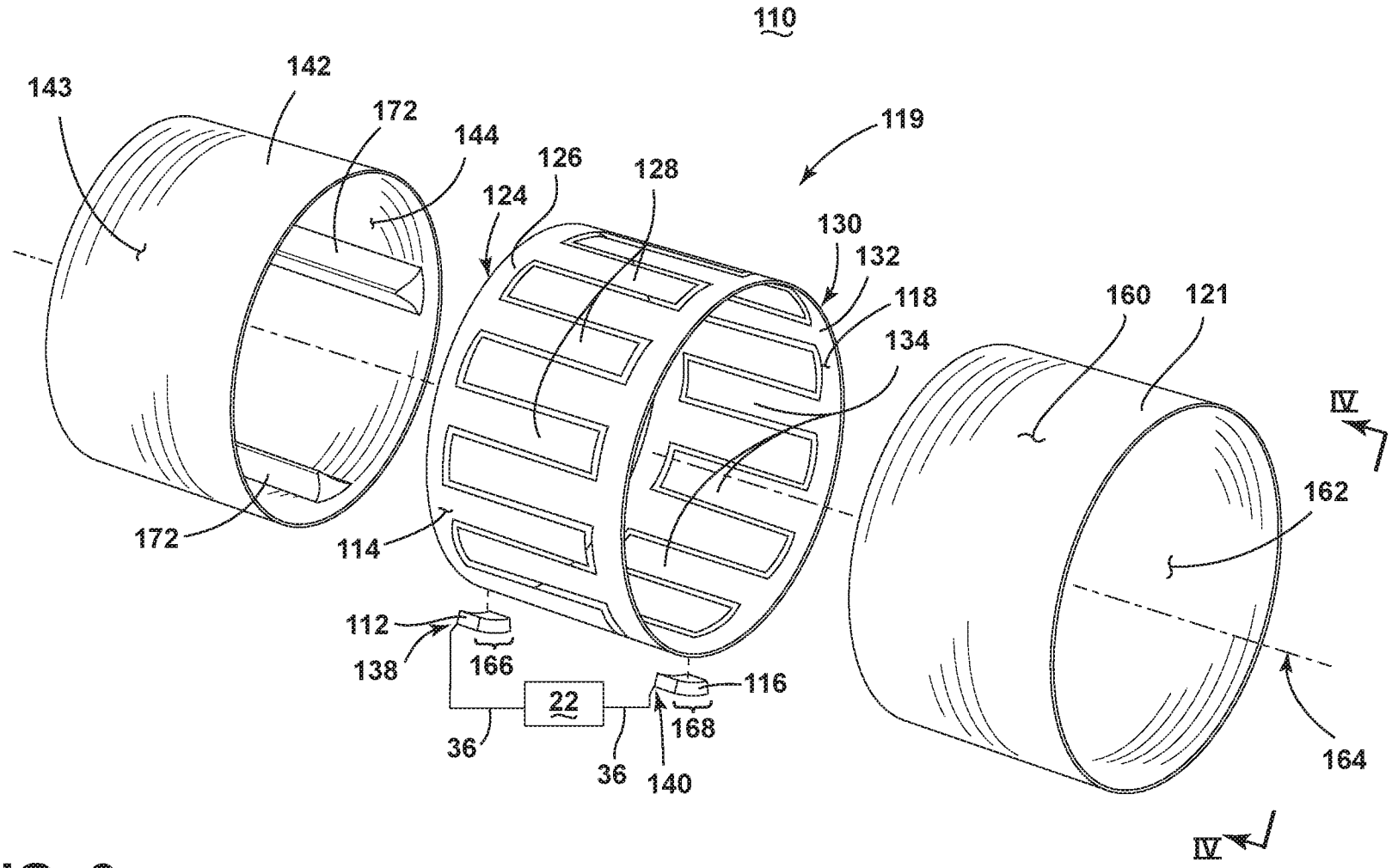
FIG. 3 is a schematic perspective view of an axially-exploded laundry treating apparatus with a rotating drum configuration, in accordance with the second embodiment of the invention.

Furthermore, FIG. 3 illustrates an alternative laundry treating appliance 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that laundry treating appliance 110 may be arranged in a drum-shaped configuration rotatable about a rotational axis 164, instead of the substantially flat configuration of the first embodiment.

In this embodiment, the support element includes a drum 119 having a non-conducting outer drum 121 having an outer surface 160 and an inner surface 162, and may further include a non-conductive element, such as a sleeve 142. The sleeve 142 further includes an inner surface 144 for receiving and supporting wet laundry. The inner surface 144 of the sleeve 142 may further include optional tumble elements 172, for example, baffles, to enable or prevent movement of laundry. The sleeve 142 and outer drum 121 may be made of any suitable low loss, fire retardant materials that isolate the conductive elements from the articles to be dehydrated. While a sleeve 142 is illustrated, other non-conductive elements are envisioned, such as one or more segments of non-conductive elements, or alternate geometric shapes of non-conductive elements.

As illustrated, the conductive second cathode element 114, and the second anode elements 118 are similarly arranged in a drum configuration and fixedly mounted to the outer surface 143 of the sleeve 142. In this embodiment, the opposing first and second comb elements 124, 130 include respective first and second bases 126, 132 encircling the rotational axis 164, and respective first and second pluralities of teeth 128, 134, interdigitally arranged about the rotational axis 164.

The laundry treating appliance 110 further includes a conductive first cathode element comprising at least a partial cathode ring 112 encircling a first radial segment 166 of the drum 119 and an axially spaced opposing conductive first anode element comprising at least a partial anode ring 116 encircling a second radial segment 168 of the drum 119, which may be different from the first radial segment 166. As shown, at least a portion of the drum 119 separates the at least partially axially-aligned cathode ring 112 and the first base 126 portion of the second cathode elements 114. Similarly, at least a portion of the drum 119 separates the at least partially axially-aligned anode ring 116 and the second base 132 portion of the second anode element 118. Additionally, this configuration aligns the first base 126 with the first radial segment 166, and the second base 132 with the second radial segment 168. Alternate configurations are envisioned where only at least a portion of the drum 119 separates the cathode or anode rings 112, 116 from their respective first and second bases 126, 132.

The RF applicator 22 may be configured to generate a field of electromagnetic radiation (e-field) within the radio frequency spectrum between outputs electrodes and may be electrically coupled between the cathode ring 112 and the anode ring 116 by conductors 36 connected to at least one respective cathode and anode ring contact point 138, 140.

Each of the conductive cathode and anode elements 112, 114, 116, 118 remain at least partially spaced from each other by a separating gap, or by non-conductive segments, such as by the outer drum 121. The outer drum 121 may be made of any suitable low loss, fire retardant materials, or at least one layer of insulating materials that isolates the conductive cathode and anode elements 112, 114, 116, 118. The drum 119 may also provide a rigid structure for the laundry treating appliance 110, or may be further supported by secondary structural elements, such as a frame or truss system.

Figure 4:
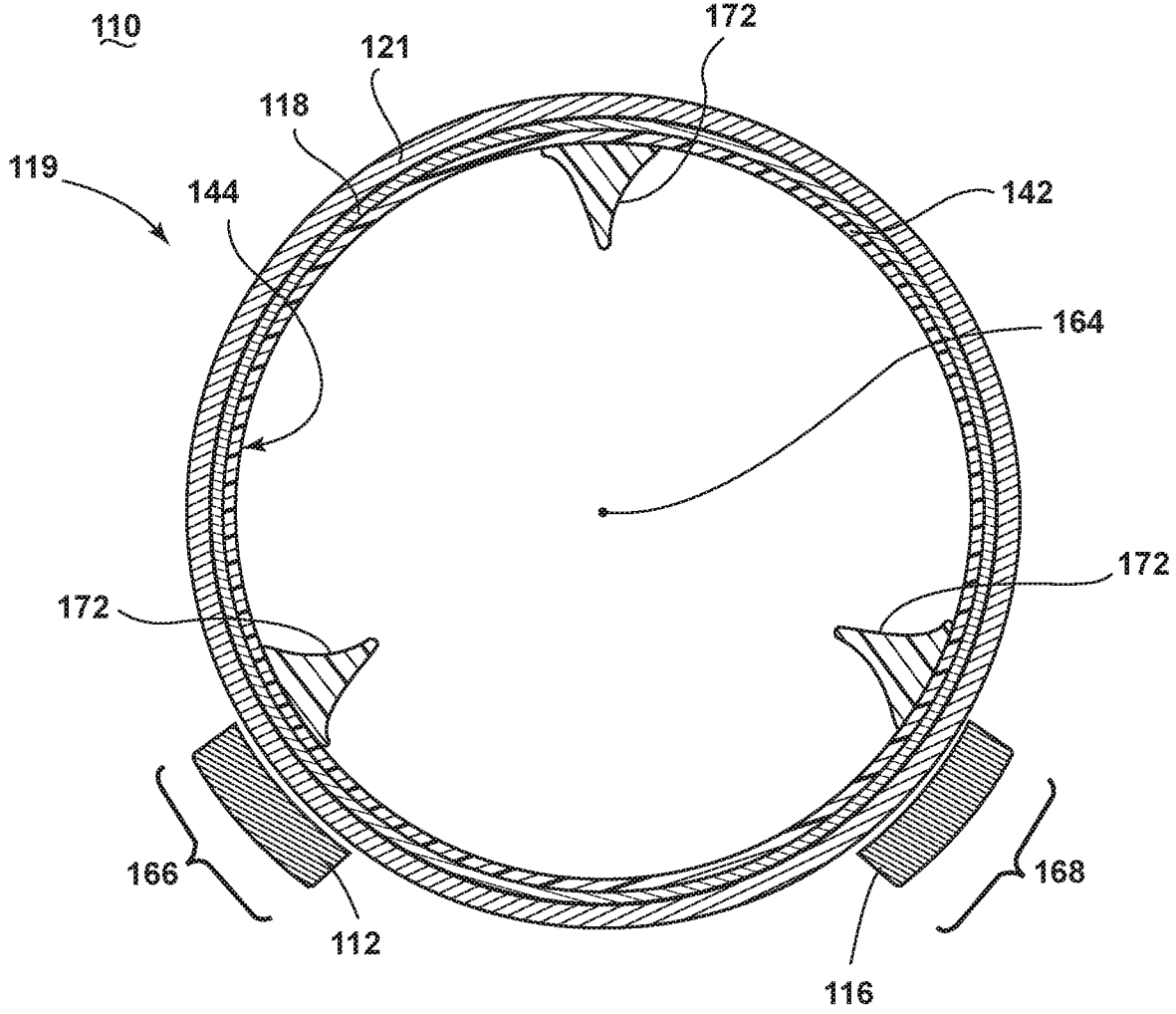
FIG. 4 is a partial sectional view taken along line 4-4 of FIG. 3 showing the assembled configuration of the drum and anode/cathode elements, in accordance with the second embodiment of the invention.

As shown in FIG. 4, the assembled laundry treating appliance 110, according to the second embodiment of the invention, creates a substantially radial integration between the sleeve 142, second cathode and anode elements 114, 118 (cathode element not shown), and drum 119 elements. It may be envisioned that additional layers may be interleaved between the illustrated elements. Additionally, while the cathode ring 112 and anode ring 116 are shown offset about the rotational axis for illustrative purposes, alternate placement of each ring 112, 116 may be envisioned.

The second embodiment of the laundry treating appliance 110 operates by creating a first capacitive coupling between the cathode ring 112 and the second cathode element 114 separated by at least a portion of the drum 119, a second capacitive coupling between the anode ring 116 and the second anode element 118 separated by at least a portion of the drum 119, and a third capacitive coupling between the pluralities of teeth 128, 134 of the second cathode element 114 and the second anode element 118, at least partially spaced from each other.

During drying operations, wet laundry to be dried may be placed on the inner surface 144 of the sleeve 142. During a cycle of operation, the drum 119 may rotate about the rotational axis 164 at a speed at which the tumble elements 172 may enable, for example, a folding or sliding motion of the laundry articles. During rotation, the RF applicator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry.

Many other possible configurations in addition to that shown in the above figures are contemplated by the present embodiment. For example, in another configuration, the cathode and anode rings 112, 116 may encircle larger or smaller radial segments, or may completely encircle the drum 119 at first and second radial segments 166, 168, as opposed to just partially encircling the drum 119 at a first and second radial segments 166, 168. In yet another configuration, the first and second bases 126 and 132 and the first and second plurality of teeth 128, 134 may only partially encircle the drum 119 as opposed to completely encircling the drum 119. In even another configuration, the pluralities of teeth 28, 34, 128, 134 may be supported by slotted depressions in the support element 20 or sleeve 142 matching the teeth 28, 34, 128, 134 for improved dielectric, heating, or manufacturing characteristics of the appliance. In another configuration, the second cathode and anode elements 114, 118 may only partially extend along the outer surface 143 of the sleeve 142.

In an alternate operation of the second embodiment, the RF applicator 22 may be intermittently energized to generate an e-field between the first, second, and third capacitive couplings, wherein the intermittent energizing may be related to the rotation of the drum 119, or may be timed to correspond with one of aligned capacitive couplings, tumbling of the laundry, or power requirements of the laundry treating appliance 110. In another alternate operation of the second embodiment, the RF applicator 22 may be moving during the continuous or intermittent energizing of the e-field between the first, second, and third capacitive couplings. For instance, the RF applicator 22 may rotate about the rotational axis 164 at similar or dissimilar periods and directions as the drum 119. In yet another alternate operation of the second embodiment, the drum may be rotationally stopped or rotationally slowed while the RF applicator 22 continuously or intermittently energizes to generate an e-field between the first, second, and third capacitive couplings.

Figure 5:
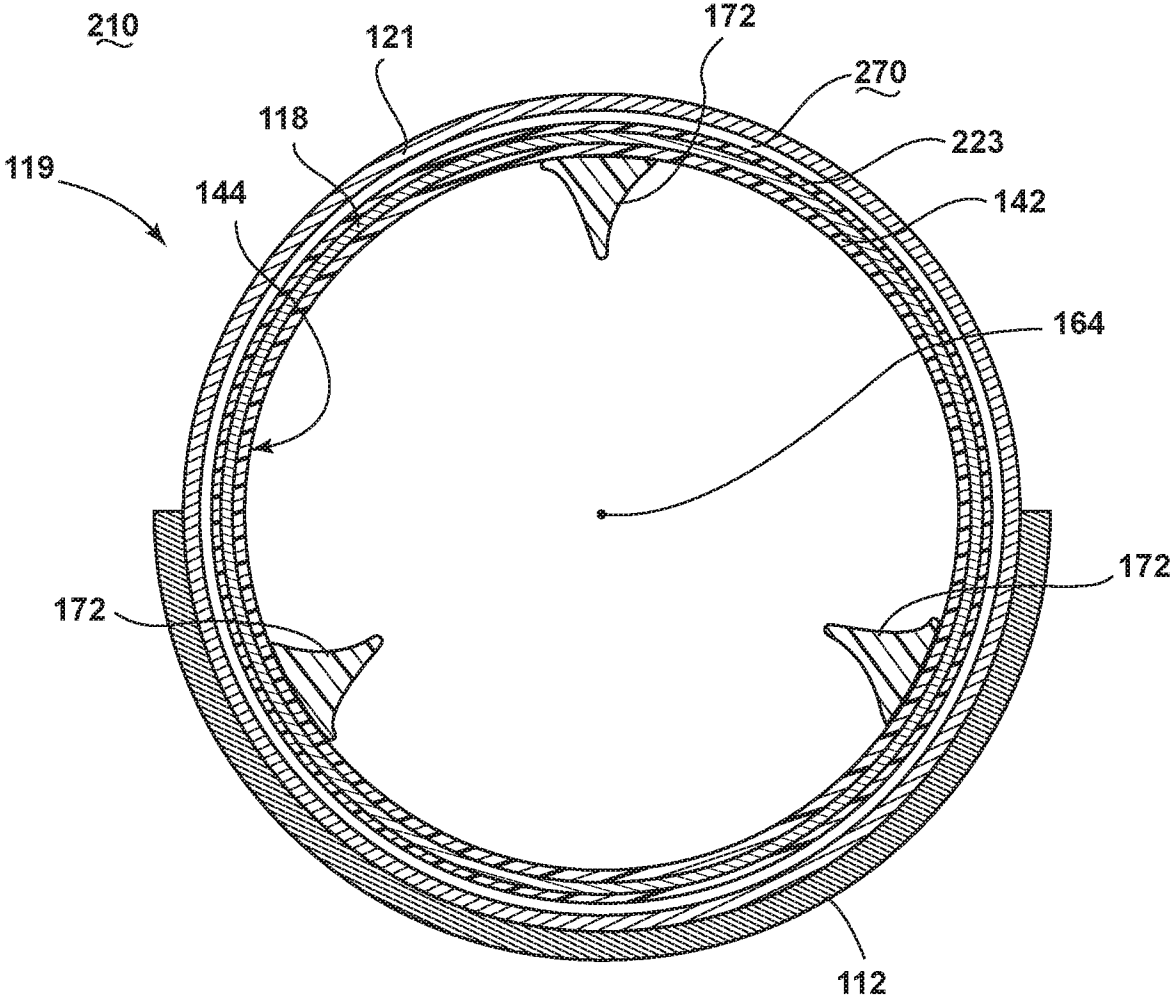
FIG. 5 is a partial sectional view showing an alternate assembled configuration of the drum and anode/cathode elements, in accordance with the third embodiment of the invention.

FIG. 5 illustrates an alternative assembled laundry treating appliance 210, according to the third embodiment of the invention. The third embodiment may be similar to the first and second embodiments; therefore, like parts will be identified with like numerals increased by 200, with it being understood that the description of the like parts of the first and second embodiment applies to the third embodiment, unless otherwise noted. A difference between the first embodiment and the second embodiment may be that laundry treating appliance 210 may be arranged in a drum-shaped configuration, wherein the outer drum 121 is separated from the second anode element 118 by a second drum element 223 and an air gap 270.

Additionally, the same anode ring 116 and cathode ring 112 (not shown) are elongated about a larger radial segment of the drum 119. Alternatively, the cathode ring 112, anode ring 116, or both rings 112, 116 may be positioned on the opposing side of the outer drum 121, within the air gap 270. In this embodiment, the air gap 270 may still separate the elements 112, 116 from the second drum element 223, or the elements 112, 116 may be in communication with the second drum element 223. The operation of the third embodiment is similar to that of the second embodiment.

Figure 6:
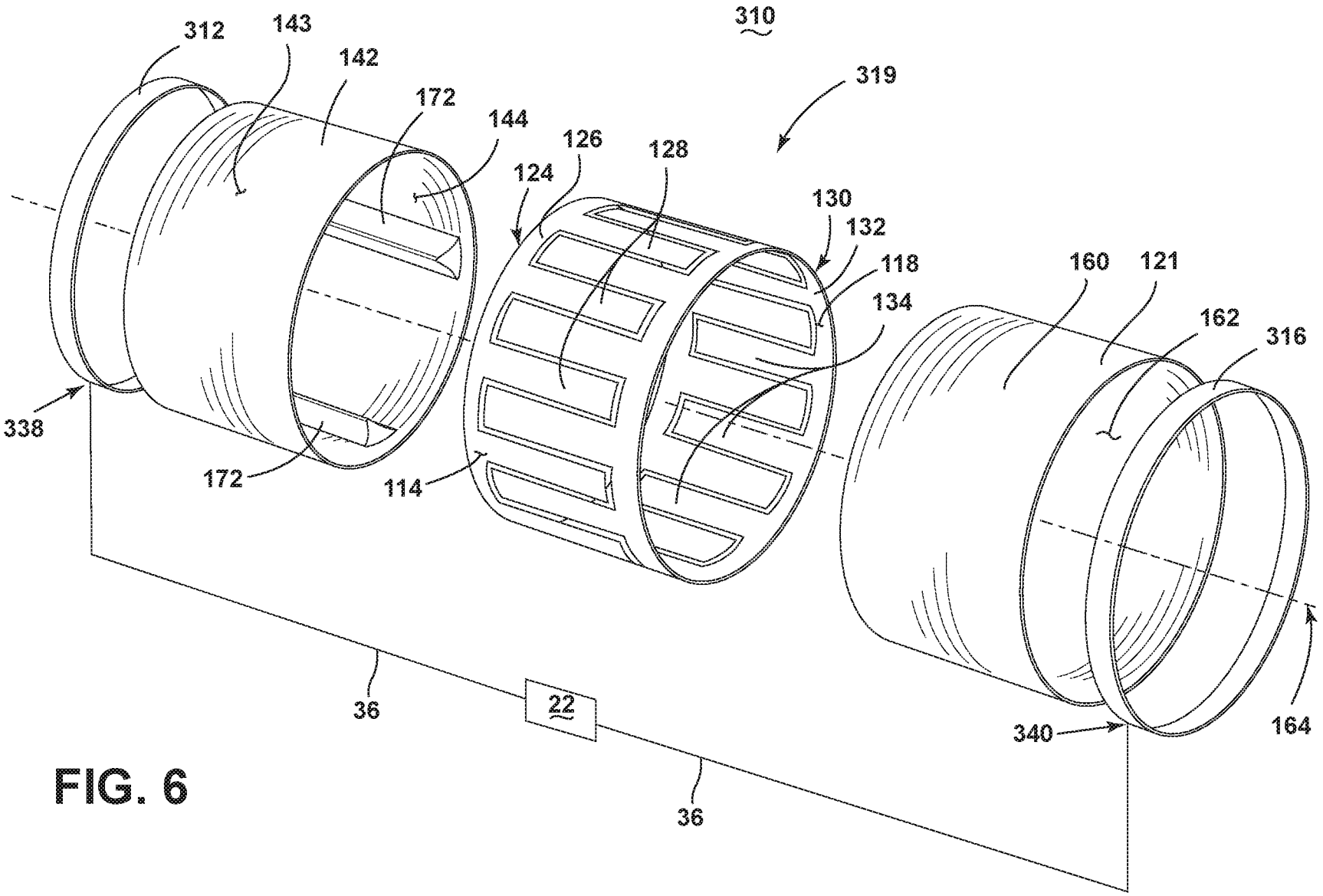
FIG. 6 is a schematic perspective view of an axially-exploded laundry treating apparatus with a rotating drum configuration having integrated anode/cathode rings, in accordance with the fourth embodiment of the invention.

FIG. 6 illustrates an alternative laundry treating appliance 310 according to a fourth embodiment of the invention. The fourth embodiment may be similar to the second or third embodiments; therefore, like parts will be identified with like numerals beginning with 300, with it being understood that the description of the like parts of the first, second, and third embodiments apply to the fourth embodiment, unless otherwise noted. A difference between the prior embodiments and the fourth embodiment may be that first cathode and anode elements include cathode and anode rings 312, 316 assembled at axially opposite ends of the drum 319. This configuration may be placed within a housing, for instance, a household dryer cabinet (not shown).

In this embodiment, the assembled cathode and anode rings 312, 316 are electrically isolated by, for example, at least a portion of the drum 319 or air gap (not shown). In this sense, the laundry treating appliance 310 retains the first and second capacitive couplings of the second embodiment.

The RF applicator 22 may be configured to generate a field of electromagnetic radiation (e-field) within the radio frequency spectrum between outputs electrodes and may be electrically coupled between the cathode ring 312 and the anode ring 316 by conductors 36 connected to at least one respective cathode and anode ring contact point 338, 340. In this embodiment, the cathode and anode ring contact points 338, 340 may further include direct conductive coupling through additional components of the dryer cabinet supporting the rotating drum 319, such as via ball bearings (not shown). Other direct conductive coupling through additional components of the dryer cabinet may be envisioned.

The fourth embodiment of the laundry treating appliance 310 operates by creating a first capacitive coupling between the cathode ring 312 and the second cathode element 114 separated by at least a portion of the drum 319 or air gap, a second capacitive coupling between the anode ring 316 and the second anode element 118 separated by at least a portion of the drum 319 or air gap. During rotation, the RF applicator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry.

Figure 7:
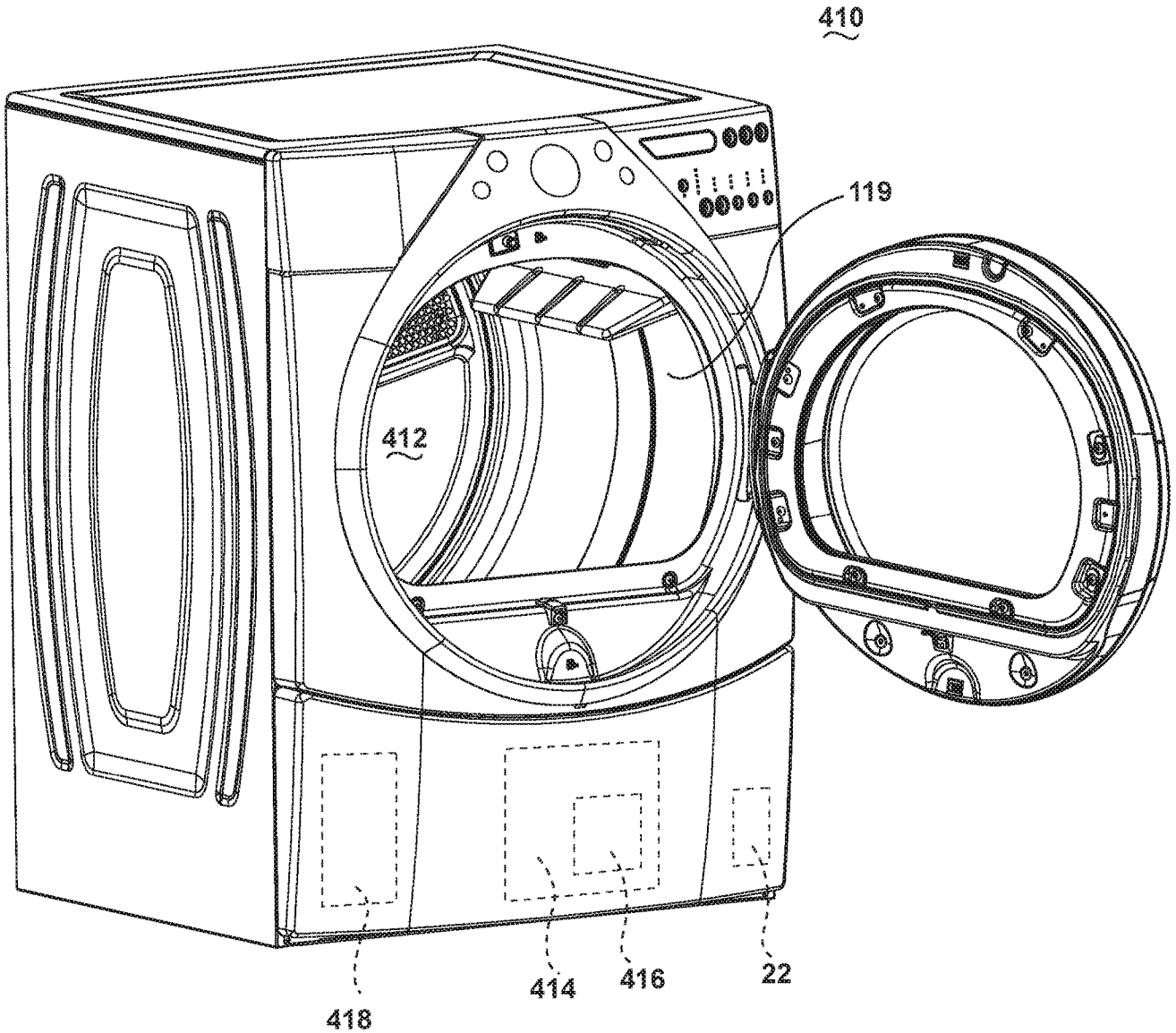
FIG. 7 is a schematic perspective view of an embodiment where the laundry treating appliance is shown as a clothes dryer incorporating the drum of the second, third, and fourth embodiments.

FIG. 7 illustrates an embodiment where the appliance is a laundry treating appliance, such as a clothes dryer 410, incorporating the drum 119, 219, 319 (illustrated as drum 119), which defines a treating chamber 412 for receiving laundry for treatment, such as drying. The clothes dryer comprises an air system 414 supplying and exhausting air from the treating chamber, which includes a blower 416. A heating system 418 is provided for hybrid heating the air supplied by the air system 414, such that the heated air may be used in addition to the dielectric heating. The heating system 418 may work in cooperation with the laundry treating appliance 110, as described herein.

Many other possible embodiments and configurations in addition to those shown in the above figures are contemplated by the present disclosure. For example, alternate geometric configurations of the first and second pluralities of teeth are envisioned wherein the interleaving of the teeth are designed to provide optimal electromagnetic coupling while keeping their physical size to a minimum. Additionally, the spacing between the pluralities of teeth may be larger or smaller than illustrated.

The embodiments disclosed herein provide a laundry treating appliance using RF applicator to dielectrically heat liquid in wet articles to effect a drying of the articles. One advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF applicator according to such additional design considerations as efficiency or power consumption during operation.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Moreover, the capacitive couplings in embodiments of the invention allow the drying operations to move or rotate freely without the need for physical connections between the RF applicator and the pluralities of teeth. Due to the lack of physical connections, there will be fewer mechanical couplings to moving or rotating embodiments of the invention, and thus, an increased reliability appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method to dry an article in a dryer drum with a radio frequency (RF) applicator having a first partial anode ring disposed adjacent to the lowest gravitational point of the drum, a second anode element, a first partial cathode ring disposed adjacent to the lowest gravitational point of the drum opposite the first partial anode ring, and a second cathode element, the method comprising:

electrically coupling an electrode of the RF applicator to the first partial anode ring and another electrode of the RF applicator to the first partial cathode ring;

capacitively coupling the first partial anode ring to the second anode element, and the first partial cathode ring to the second cathode element;

capacitively coupling the second anode element to the second cathode element; and energizing the RF applicator to energize the first partial anode ring and the first partial cathode ring, thereby inducing energization between the first partial anode ring and the second anode, and between the first partial cathode ring and the second cathode respectively to generate a field of electromagnetic radiation (e-field) between the second anode and second cathode elements;

wherein liquid in the article residing within the e-field is dielectrically heated by the e-field to effect a drying of the article.

2. The method of claim 1, further comprising moving the RF applicator during the energization of the RF applicator.

3. The method of claim 2 further comprising a support element in the shape of a drum and the moving the RF applicator comprises rotation of the drum.

4. The method of claim 3 wherein the e-field is located above at least a portion of an inner surface of the drum and the article is supported on the inner surface of the drum.

5. The method of claim 4 wherein the rotation of the drum is at a speed to effect a slide motion of the article on the inner surface.

6. The method of claim 4 wherein the rotation of the drum is at a speed to effect a tumble motion of the article on the inner surface.

7. The method of claim 4 wherein the energization of the RF applicator comprises intermittent energization of the RF applicator.

8. The method of claim 7 wherein the rotation of the drum is related to the intermittent energization of the RF applicator.

9. The method of claim 4 wherein the capacitively coupling comprises capacitive coupling between the first partial anode ring and the second anode element at a first radial segment of the drum and capacitive coupling between the first partial cathode ring and the second cathode element at a second radial segment of the drum, axially spaced from the first radial segment.

10. The method of claim 9 wherein the first partial anode ring is a first conductive ring fully encircling the drum about the first radial segment and the first partial cathode ring is a second ring fully encircling the drum about the second radial segment.

11. The method of claim 1 wherein the RF applicator is energized at an RF frequency.

12. An article treatment appliance to dry an article according to a predetermined cycle of operation, comprising:

a first partial anode ring partially encircling a first radial segment of a drum and disposed adjacent to the lowest gravitational point of the drum;

a first partial cathode ring partially encircling a second radial segment of the drum disposed adjacent to the lowest gravitational point of the drum opposite the first partial anode ring;

a second anode element and a second cathode element;

the first partial anode ring capacitively coupled with the second anode element and operably separated by a dielectric;

the first partial cathode ring capacitively coupled with the second cathode element and operably separated by a dielectric; and a radio frequency (RF) applicator with an electrode electrically coupled with the first partial anode ring and another electrode electrically coupled with the first partial cathode ring and operable to selectively energize the first partial anode ring and the first partial cathode ring in a radio frequency spectrum;

wherein the energization of the first partial anode ring and first partial cathode ring induces energization between the first partial anode ring and the second anode, and between the first partial cathode ring and the second cathode to generate a field of electromagnetic radiation in the radio frequency spectrum between the second anode and the second cathode, operable to dielectrically heat liquid within the article.

13. The article treatment appliance of claim 12 wherein the drum includes inner and outer surfaces, and the article is supported on the inner surface.

14. The article treatment appliance of claim 13 wherein the drum is operably rotatable about a rotational axis.

15. The article treatment appliance of claim 14 wherein the first partial anode ring fully encircles the first radial segment of the drum, and the first partial cathode ring fully encircles the second radial segment of the drum, which is different from the first radial segment.

16. The article treatment appliance of claim 15 wherein the first and second radial segments are axially spaced from each other.

17. The article treatment appliance of claim 15 wherein the second anode element comprises a first comb element having a first base from which extend a first plurality of teeth, the second cathode element comprises a second comb element having a second base from which extend a second plurality of teeth, with first and second plurality of teeth are interdigitally arranged, and the first base is axially aligned with the first radial segment and the second base is axially aligned with the second radial segment.

18. The article treatment appliance of claim 12 wherein the second anode element comprises a first comb element having a first base from which extend a first plurality of teeth, the second cathode element comprises a second comb element having a second base from which extend a second plurality of teeth, with first and second plurality of teeth are interdigitally arranged.

* * * * *